United States Patent [19]

Hines et al.

[11] 4,031,616

[45] June 28, 1977

[54] CARDBOARD CUTTER IMPLEMENT

[76] Inventors: Clyde A. Hines, 16573 Englewood Ave., Los Gatos, Calif. 95030; Clyde C. Hines, 1103 N. Kenwood, Burbank, Calif. 91505

[22] Filed: Sept. 22, 1975

[21] Appl. No.: 615,689

[52] U.S. Cl. ..... 30/2; 30/293; 30/294

[51] Int. Cl.[2] ..... B67B 7/30; B26B 3/08

[58] Field of Search ..... 30/2, 288, 291, 293, 30/294, 30, 320, 321; 33/42; 83/52

[56] References Cited

UNITED STATES PATENTS

| | | | |
|---|---|---|---|
| 1,821,718 | 9/1931 | Melcher | 30/294 X |
| 1,909,780 | 5/1933 | McCann | 30/294 X |
| 1,937,660 | 12/1933 | Luker | 33/42 X |
| 2,067,986 | 1/1937 | Schmidt | 30/2 |
| 2,095,164 | 10/1937 | Babb | 30/2 |
| 2,249,195 | 7/1941 | Unsinger | 30/2 |
| 2,291,075 | 7/1942 | Hanson | 30/2 |

FOREIGN PATENTS OR APPLICATIONS

| | | | |
|---|---|---|---|
| 1,123,524 | 9/1956 | France | 30/2 |

*Primary Examiner*—Gary L. Smith
*Attorney, Agent, or Firm*—Gerald L. Moore

[57] ABSTRACT

A cutter implement for cutting cardboard such as those used for opening cardboard boxes and including a guide member for guiding the implement along the box edge and wherein the cutter blade can be adjusted to extend at an angle to the guide member so as to cut into the corner of the box and not damage any of the contents of the box.

1 Claim, 8 Drawing Figures

CARDBOARD CUTTER IMPLEMENT

BACKGROUND OF THE INVENTION

In a grocery stores and other retail outlets where goods are received in cardboard cartons, it is necessary to open the cartons for display of the contents. Such cartons usually are glued shut thereby making it necessary to cut through the lid to permit removal of the goods. Usually such goods comprise canned goods or boxes of food such as cereals, sugar, macaroni, et cetera.

In opening the cardboard cartons, it is quite easy to cause a cutting blade to cut through the cardboard and extend into the interior of the box. When this occurs, there will result damage to the contents of the box such as the cutting open of cereal boxes, sugar boxes or other such foodstuffs so that the damaged merchandise must either be thrown away or is greatly reduced in value.

One other method of displaying boxed merchandise is what is referred to as tray packing. In this method a portion of one side of the cardboard box is removed as well as the top with the box and contents both being set on the shelf for display. Frequently canned soups are displayed in this manner because it does not require removal of the individual cans from the cardboard carton. However such cutting of the carton also requires that the cut not only be accurate in depth but also that it be made some distance from the box edge thereby requiring a different manner of cutting than if just the top is to be removed.

It is the purpose of the subject invention to provide an effective means for cutting open cardboard cartons in a manner to minimize or prevent damage to the contents of the carton.

SUMMARY OF THE INVENTION

A cardboard cutter implement comprising a handle and a cutter blade mounted on the handle and extending therefrom through an opening in a baseplate fixed to the handle with a guide also fixed to the handle in a manner to permit adjustment of the angle between the guide and baseplate combination and the cutter blade such that the cutter blade can be caused to cut into the cardboard at an angle thereby making it possible to open the carton in a method of cutting into the corner of a box.

DESCRIPTION OF THE INVENTION

Figure 3:
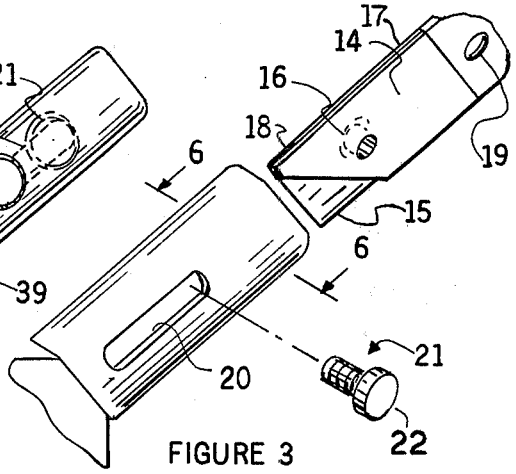
FIG. 3 is a slightly enlarged view of the handle showing the manner in which the cutter blade is removed.
Figure 6:
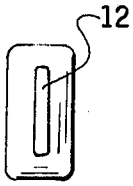
FIG. 6 is a cross-sectional view of the handle along the line 6—6 of FIG. 3.

In the drawing is shown one embodiment of the invention which can be used for opening cardboard boxes or other such cartons in the manner previously discussed. The implement 10 includes a handle 11 which in this instance is configured to be grasped in one hand much in the same manner as a knife. As shown in FIG. 6 the handle includes a channel 12 running lengthwise therethrough and having a rectangular cross-section into which fits a holder 14 (FIG. 3) for a cutter blade 15. The blade is inserted into a slot in the end of the holder and a screw 16 is passed through the holder and into a threaded opening in a plate 17 on the opposite side of the blade. In this manner the plate is drawn tightly against the blade with the plate including flanges 18 on the edges thereof extending around the edges of the holder to maintain the parts in alignment. Thus the cutter blade is maintained in the holder for insertion into the handle.

The holder and blade combination are inserted into the channel 12 in the handle with the blade passing therein first so as to extend down through the handle to a point where the blade extends through an opening in the bottom of the handle. This brings a threaded opening 19 in the blade holder into alignment with a slot 20 in the handle for the insertion of a bolt 21 therein which can be tightened for maintaining the blade holder and handle in the position desired. By loosening the bolt 21 and sliding the holder up and down in the handle, the distance the blade projects below the bottom of the handle can be adjusted. The purpose of this adjustment will be explained later. The bolt 21 can be provided with a head portion 22 such that it can be easily grasped by the fingers for tightening and loosening without the use of tools.

Figure 2:
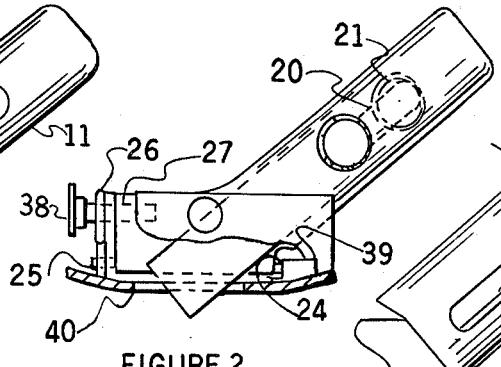
FIG. 2 shows the cutter implement and the manner in which the depth of cut of the cutter blade is adjusted.

The bottom end of the handle includes a pair of studs 24 and 25 extending along a line running parallel to the plane of the cutter blade. Extending perpendicular to the plane of these studs is the front face 26 of the handle having a threaded opening 27 therein facing towards the front or left side of the implement as viewed in FIG. 2. These lugs and projections are used to fix the baseplate and guide to the handle.

Figure 1:
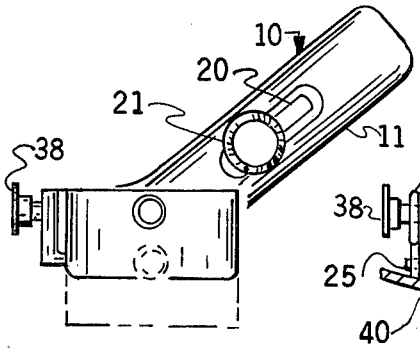
FIG. 1 is a side plan view of the cutter implement showing the manner of adjusting the position of the guide member.
Figure 4:
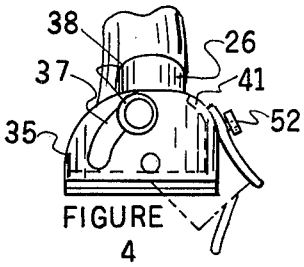
FIG. 4 is a slightly enlarged end view of the cutter showing the means for adjusting the angle between the cutter blade and the baseplate and guide.
Figure 5:
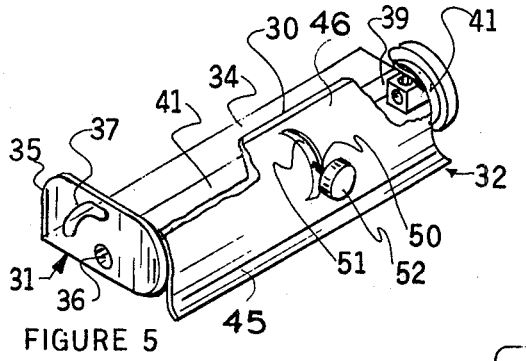
FIG. 5 shows the baseplate and guide mechanism.

The baseplate and guide assembly 30 is shown in FIG. 5 and comprises the baseplate 31 with the attached guide member 32. The baseplate comprises an arcuate bottom plate 34 and a front flange 35 extending normal thereto. In the front flange is positioned an opening 36 and an arcuate recess 37 for receiving respectively the lug 25 (FIG. 2) and a thumb screw 38. Fixed to the rear or right side of the baseplate is a standard 39 (FIG. 2) which includes a recess for receiving the lug 24. While not shown, this standard can be fixed to the baseplate by screws so that it can be removed for ease of assembly of the baseplate to the handle. Thus it can be seen that by loosening the thumb screw 38, the baseplate can be rotated about the center line passing through the lugs 24 and 25 to the positions shown in dashed line outline in FIGS. 1 and 4.

The baseplate includes an elongated aperture 40 through which the cutter blade can project. Since the blade extends through the baseplate substantially in a plane coinciding with the center line of the lugs 24 and 25, adjustment of the angle of the baseplate relative to the handle does not change the position of the blade relative to the aperture 40. The cutting edge of the blade also extends at an angle to the baseplate in the plane of the blade to provide a slicing action as the implement is drawn across the carton surface. Extending from one side of the baseplate in the same direction as the end flange 35 is a side flange 41 fixed at one edge to the baseplate. The side flange is an extension of the baseplate extending upwards in an arcuate configuration as shown more clearly in FIGS. 4, 7 and 8.

The guide member 32 has an arcuate cross-sectional configuration corresponding in shape to the arcuate side flange 41 of the baseplate. Thus the guide member is supported on the side flange by a bolt 50 inserted from the inside out through a slot 51 in the side flange onto which is threaded the thumb nut 52 on the outside of the guide member. By tightening the thumb nut, the bolt 50 pulls the guide member and the side flange 41 tightly together to hold the guide in the position desired. Also when the guide is moved to extend past the baseplate to the dotted line position shown in FIGS. 1 and 4 it serves to protect the blade and prevent injuries while the implement is being carried.

Figure 7:
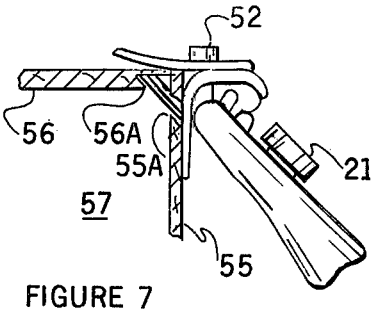
FIG. 7 shows an end view of the cutter implement used to cut into the corner of a cardboard box for removal of the top.

It has been found advantageous to open cartons by the method of cutting the corner therefrom around the edge of one side. In so doing, the cut is made diagonally along a line parallel but spaced from the edge of the carton as shown in FIG. 7. Therein a portion of the top wall 56 and the side wall 55 of a carton is shown. By making a cut 55A into the side wall such that the cut barely communicates with the interior 57 of the carton, and extending the cut 56A into the inside surface of the top wall of the container, the top wall can be lifted from the carton. By making the cut sufficiently close to the top edge of the carton such that the inside surface of the side wall is severed very close to the juncture thereof with the inside surface of the top wall, there is little chance of damage to any articles in the interior cavity 57 of the carton.

For setting the tool to open cartons by the cutting of the corner around one side as described, first the thumb nut 52 is loosened and the guide member 32 is rotated so as to project below the baseplate 31. The more parallel the guide member is relative to the blade, the wider the cut. In other words, the greater the angle between the guide and blade, the smaller the cut depth across the carton corner thus allowing adjustment for various thicknesses of carton side walls. Thus after the thumb nut 52 is tightened to hold the guide member in the position selected the thumb screw 38 is loosened to adjust the angle at which the blade 15 extends through the baseplate so as to cut through the side wall of the carton as described previously and illustrated in FIG. 7.

As can be seen in FIG. 7 the carton is severed through the side wall 55 and the top wall 56. Preferably for opening the carton without damaging any contents located in the cavity 57, the angle of the blade is adjusted as shown so that it cuts through the very edge of the side wall 55 by severing both the outside and the inside surfaces and thereafter into the top wall 56 near the juncture of the top wall and side wall inside surfaces as illustrated. It will be noted that the blade barely penetrates the cavity 57. The depth of blade is adjusted by loosening the wing nut 21 and moving the blade in the handle so that the blade tip extends to a position closely adjacent the guide member 32. Thereafter by pulling the implement along the side wall of the box with the baseplate resting firmly on the side wall 55 and the guide member bearing firmly against the top wall 56 thereof, a cut is made across the corner of the box by a method which if accomplished completely around the periphery thereof will enable the easy lifting off of the top. Because the blade has passed primarily through the side walls of the box and has penetrated only slightly into the cavity, the contents of the box are unharmed. The side walls usually are of equal thickness throughout in contrast to the top made up of various flaps thereby causing the thickness to be of single and double thicknesses at different locations. Thus it is preferable to cut into the side wall first because the cutter blade depth can be more accurately set. Also with the cut being made around the top edge, the box contents tend to settle downward away from the top lessening the chance of being cut by the blade.

Figure 8:
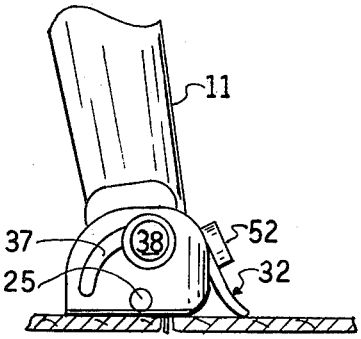
FIG. 8 shows the cutter implement being used to cut through the side of a cardboard box.

However, if it is desired to cut into only one side wall of the box as necessary in tray packing, the thumb nut 52 can be loosened and the guide member swung upward so that no portion thereof extends down below the baseplate as shown in FIG. 8. Thereafter this thumb nut is tightened and the thumb screw 38 loosened for pivoting of the baseplate so that the cutter blade can extend either substantially perpendicular or at an angle thereto. Thereafter by loosening the bolt 21, the depth of cut of the blade can be adjusted by varying the distance the blade extends through the baseplate aperture so the perpendicular distance to the blade tip is roughly equal the thickness of the cardboard wall 58 which is to be cut. By now pulling the implement along the wall in the manner illustrated with the baseplate resting flatly against the cardboard box wall, the box wall will be cut. Because the depth of cut is closely regulated, there is little chance of the contents of the box being damaged. By cutting the side wall at an angle other than normal to the wall surface, the possibility of cutting the carton contents is lessened since a deeper cut can be made in the side wall without the blade severing the inside surface.

In accordance with another feature of the invention, the baseplate and guide are both formed with the bottom or downward extending surfaces arcuate and convex. This feature is better shown in FIGS. 2, 5 and 7. This arcuate configuration allows the baseplate in particular to pass across the uneven carton surface substantially without the forward edge catching on any protruding edges in the box surface. Such box surfaces tend to be uneven due to the corrugated construction and the convex shaped baseplate and guide raises the forward edges from the outside surfaces thereof with little or no chance of catching on any indentations therein.

The invention claimed is:

1. A cardboard cutting implement comprising in combination:

a handle;

a baseplate having a bottom planar surface with an aperture therethrough;

a planar cutter blade having one edge sharpened to form a cutting edge;

blade support means for fixing the blade to the handle with the cutting edge thereof positioned to contact and cut a surface as the handle is grasped and moved along said surface; and baseplate support means for adjustably attaching said baseplate to said handle such that the blade extends through said baseplate aperture and the baseplate can be pivoted relative to the handle in a direction to change the angle between the plane of the baseplate bottom planar surface and the plane of the planar cutter blade thereby to adjust the angle the blade enters the cardboard surface and vary the angle of the cut made in the cardboard; and a planar guide in combination with adjustable guide support means fixing the guide to said baseplate in a position to extend beyond the baseplate bottom surface with the plane thereof extending generally parallel to and in the general direction of the plane of the cutter blade with said guide support means being adjustable for varying the angle between the plane of the guide and the plane of the cutter blade.

* * * * *